US005187836A

United States Patent [19]

Kim et al.

[11] Patent Number: 5,187,836

[45] Date of Patent: Feb. 23, 1993

[54] DOOR HINGE ARRANGEMENT FOR OPENING THE DOOR AT EITHER SIDE

[75] Inventors: Yong M. Kim; Jeh S. Oh, both of Suwon, Rep. of Korea

[73] Assignee: Samsung Electronics Co., Ltd., Suwon, Rep. of Korea

[21] Appl. No.: 540,329

[22] Filed: Jun. 19, 1990

[30] Foreign Application Priority Data

Jun. 20, 1989 [KR] Rep. of Korea ..... 1989-8464

[51] Int. Cl.[5] ..... E05D 15/50

[52] U.S. Cl. ..... 16/231; 16/233

[58] Field of Search ..... 16/231, 232, 233

[56] References Cited

U.S. PATENT DOCUMENTS

| | | | |
|---|---|---|---|
| 2,261,147 | 11/1941 | Dow | 16/232 |
| 2,349,486 | 5/1944 | Crosman | 16/232 |
| 3,889,419 | 6/1975 | Maleck | 16/232 X |
| 4,495,673 | 1/1985 | Khan | 16/232 |
| 4,503,583 | 3/1985 | Frohbieter | 16/232 |
| 4,503,584 | 3/1985 | Malchow | 16/232 |
| 4,947,583 | 8/1990 | Inui et al. | 16/232 X |

*Primary Examiner*—Richard K. Seidel
*Attorney, Agent, or Firm*—Robert E. Bushnell

[57] ABSTRACT

A door hinge arrangement for various home appliances such as a refrigerator, which permits opening of the door alternatively at either sie. The arrangement includes couples of hinge plates, receiving plates and locking pins engaged with the hinge plates, a connecting lever operationally connecting the locking pins to each other, and a pair of torsional springs for transmitting the movement of the locking pins to the connecting lever along guide grooves formed on the receiving plates. In this arrangement, the overall structure is simplified and opening of the door is carried out smoothly, as the hinge plates are connected directly to the connecting lever by the locking pins and the springs.

11 Claims, 3 Drawing Sheets

DOOR HINGE ARRANGEMENT FOR OPENING THE DOOR AT EITHER SIDE

BACKGROUND OF THE INVENTION

1. Field of the Invention

The present invention relates to a door hinge arrangement for various home appliances such as a refrigerator, and more particularly to a door arrangement which permits opening of the door alternatively at either side.

2. Description of the Prior Art

The conventional door hinge arrangement of this kind is so constructed that one side of the door should be locked so that the door can be opened at the other side, and thus suffers from the disadvantages that the number of the constitutional parts and manufacturing and assemblying steps therefor are increased. A further disadvantage is that the opening and closing operation of such door is not made smoothly.

SUMMARY OF THE INVENTION

It is an object of the present invention to provide a door hinge arrangement for various home appliances which enables the door to be smoothly opened at either of the right and left hand side.

It is another object of the present invention to provide a door hinge arrangement for opening the door at either side which has a simple structure and is cost-effective to manufacture.

In order to accomplish the above objects, the door hinge arrangement according to the present invention uses:

first and second hinge assemblies attached respectively to the upper and lower edges of a door;

upper and lower receiving plates fixed at the upper and lower edges of the door;

first and second locking means received between said receiving plates for engaging with first and second door hinge shafts respectively;

connecting means received between said receiving plates and operationally connecting the first and second locking means, said connecting means being so arranged that one of the first and second locking means is engaged with the corresponding door shaft hinge means when the other locking means is disengaged from the other hinge means;

first and second spring means for transmitting the movement of the first and second locking means to said connecting means along guide grooves formed on said receiving plates; and first and second means for keeping the first and second locking means as being engaged with or disengaged from the first and second hinge means when they are so engaged with or disengaged from the hinge means respectively.

BRIEF DESCRIPTION OF THE DRAWINGS

The present invention will now be described by way of illustrative example with reference to the accompanying drawings in which.

DETAILED DESCRIPTION OF THE PREFERRED EMBODIMENT

Figure 3A:
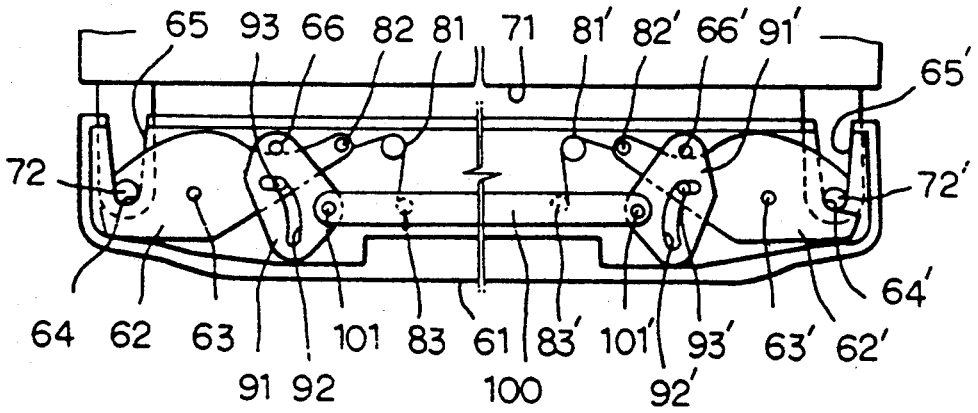
FIG. 3A (PRIOR ART)
FIG. 3A is a top plan view showing the conventional door hinge arrangement when the door is in its closed position.
Figure 3B:
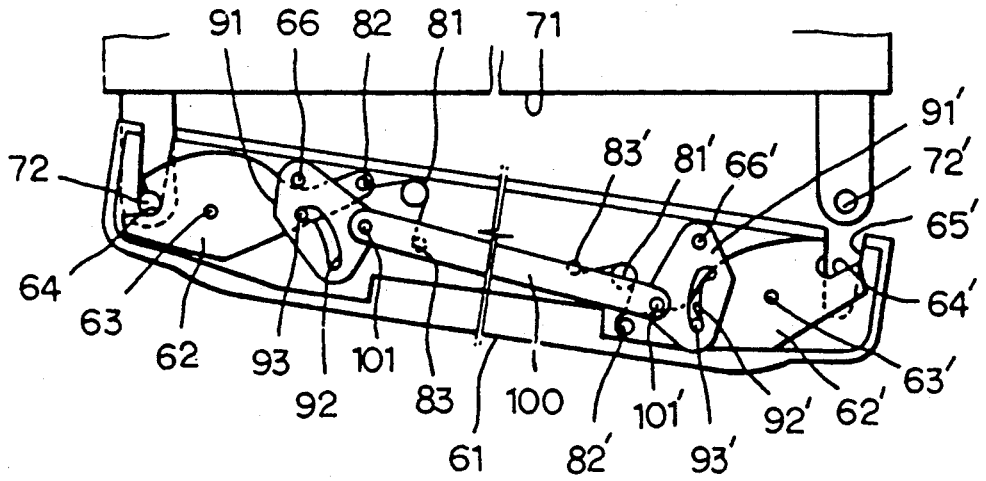
FIG. 3B (PRIOR ART)
FIG. 3B is a top plan view showing the door of FIG. 3A in the initial state of opening the door at its right hand side.

As shown in FIGS. 3A and 3B showing the conventional door hinge arrangement, holders 61 are attached to the upper and lower edges of the door. When the door is to be opened at one side thereof, the holders 61 should be locked on the other side. In both sides of the holders 61, hinge plates 62 and 62' serving as the hinge means are mounted to pivot on shafts 63 and 63'. Hinge grooves 64 and 64' are formed on outer sides of the hinge plates 62 and 62' in order to lock door shafts 72 and 72' fixed at the right and left sides of the body 71 of the appliance. The door shafts 72 and 72' are engaged with the move away from the grooves 64 and 64' along guide grooves 65 and 65' formed at both sides of upper and lower plates of the holder 61. Outer ends of torsional springs 81 and 81' are fixed at the inner ends of the hinge plates 62 and 62' by means of pins 82 and 82'. Locking pins 93 and 93' are fixed between the pins 82 and 82' and the shafts 63 and 63', and engaged with slide holes 92 and 92' formed on locking plates 91 and 91' serving as the lock means, respectively.

The upper ends of the locking plates 91 and 91' are pivotally connected to the holder 61 by means of stop pins 66 and 66' which hold the inner ends of the hinge plates 62 and 62'. The inner parts of the locking plates 91 and 91' are pivotally connected to both ends of coupling lever 100 by coupling pins 101 and 101' respectively. The inner ends of the springs 81 and 81' are fixed to the holder 61 by pins 83 and 83'.

Referring to FIG. 3B, when the door is opened at its right hand side, the door shaft 72' engaged with the hinge groove 64' of the hinge plates 62' is released and moves away from the guide groove 65', making the hinge plate 62' rotate counterclockwise about the shaft 63'. Therefore, the locking pin 93' moves toward the lower end of the slide hole 92' of the locking plate 91', making the locking plate 91' rotate clockwise about the stop pin 66' in proportion to the moving distance of the locking pin 93', and thus the coupling lever 100 is pulled toward its right hand side in proportion to the rotating movement of the locking plate 91'. Simultaneously, the locking plate 91 pivotally connected to the left end of the coupling lever 100 by the coupling pin 101 also rotates clockwise about the stop pin 66, and thus the lock pin 93 moves to the upper end of the slide hole 92, locking the hinge plate 62 in its initial position. In conclusion, the left hinge plate 62 remains locked and the door may not be opened at its left hand side, when it can be opened at its right hand side, and vice versa.

Such conventional door hinge arrangement is attached on both of the upper and lower edges of the door, and thus four hinge plates and four locking plates as well as two coupling levers are required for a door. Also, four coupling pins for pivotally connecting the locking plates and the coupling lever are needed. Therefore, the number of the structural parts or components as well as the manufacturing and assemblying steps for these parts are increased. Moreover, the hinge means and the coupling means are co-operated by way of the locking plate, making the door hard to be opened and closed smoothly.

Figure 1:
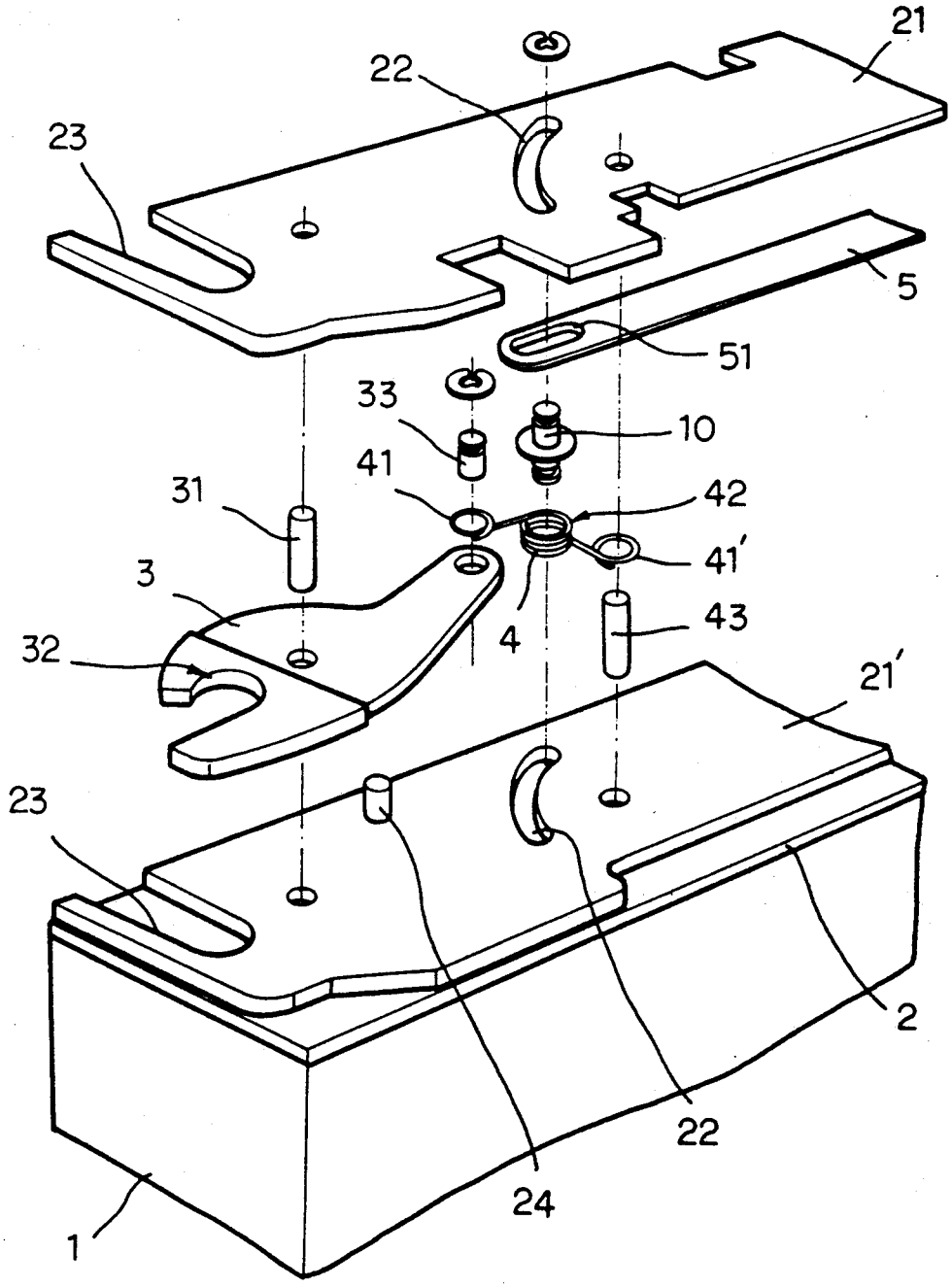
FIG. 1 is a partially cutaway exploded perspective view of the embodiment according to the present invention.

Referring to FIGS. 1 and 2 showing the embodiment of the present invention, the holders 2 are attached to the upper and lower edges of the door 1 and arcuate slide holes 22 and 22' symmetrical to each other are formed at both right and left sides of the upper and lower receiving plates 21 and 21' provided on the holder 2. U-shaped guide grooves 23 and 23' are formed at both ends of the upper and lower receiving plates 21 and 21' and the left and right door shafts 12 and 12' engage with and move away from the guide grooves 23 and 23'. Stop pins 24 and 24' are fixed to both sides of the receiving plates 21 and 21'.

On the other hand, hinge plates 3 and 3' are mounted to pivot on shafts 31 and 31' at the left and right sides of the holder 2 and the locking grooves 32 and 32' formed on outer ends of the hinge plates 3 are engaged with the door shafts 12 and 12'. The inner ends of the hinge plates 3 and 3' are connected to the respective outer ends 41 of the torsional springs 4 and 4' which transmit the movement of the locking grooves to a connecting lever 5 serving as the connecting means. The inner ends 41' of the springs 4 and 4' are fixed to the pins 43 and 43' which are secured between the receiving plates 21 and 21'. The middle portions 42 of the springs 4 and 4' are engaged to the lower parts of the locking pins 10 and 10' serving as the locking means, and the lower ends of these locking pins 10 and 10' are engaged with the slide holes of the receiving plates 21'.

The torsional springs 4 and 4' also act as the maintaining means which keeps the locking grooves 32 and 32' as being engaged or disengaged when they are so engaged with or disengaged from the door shafts 12 and 12'. The upper ends of the locking pins 10 and 10' pass through oblong holes 51 and 51' of a predetermined length formed at both ends of the connecting lever 5 and are engaged with the slide holes 22 and 22' of the receiving plates 21 and 21'.

Figure 2A:
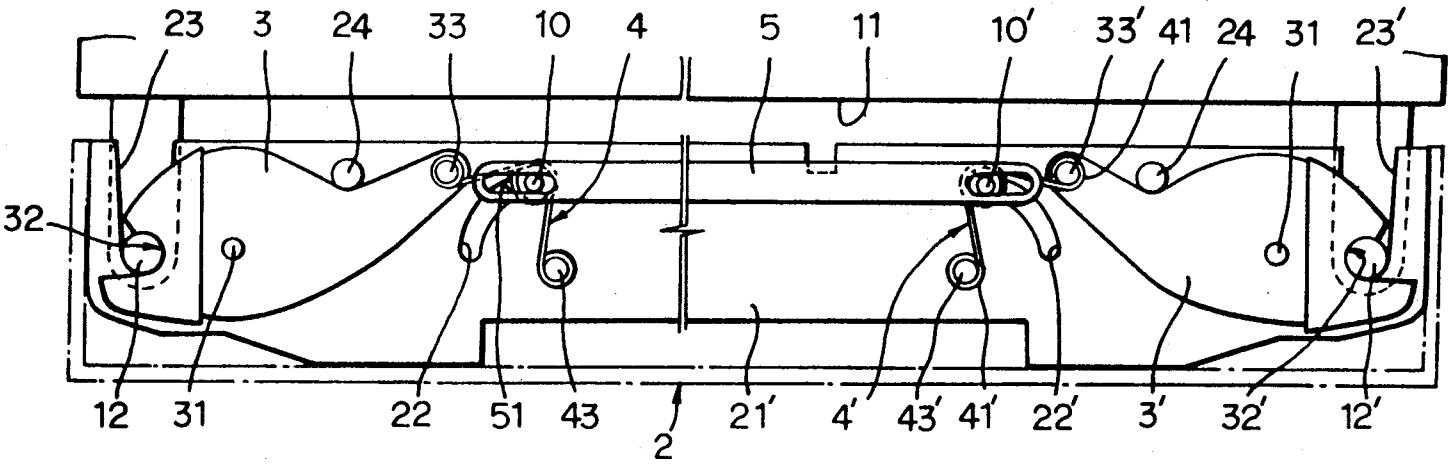
FIG. 2A is a top plan view of the embodiment of FIG. 1 when the door is in its closed position.
Figure 2B:
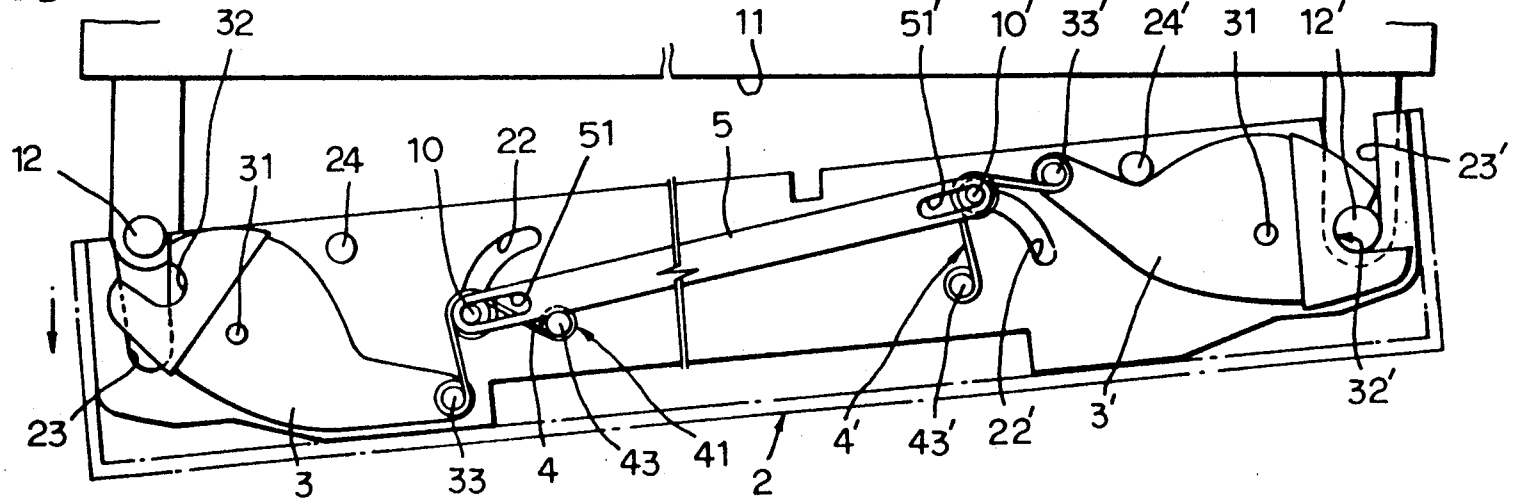
FIG. 2B is a top plan view of the embodiment of FIG. 1 in the initial state of opening the door at its left hand side.

When the door is to be opened at its left hand side, the left side of the holder 2 also rotates about the right door shaft 12' of the main body 11 as can be seen from FIGS. 2A and 2B. Therefore, the locking grooves 32 of the left hinge plate 3 and the left guide grooves 23 of the upper and lower receiving plates 21 and 21' move away from the left hinge shaft 12. At this moment, the hinge plate 3 rotates clockwise about the shaft 31 by the door shaft 12 moving away from the locking groove 32, and thus the torsional spring 4 connected to the inner end of the hinge plate by the pin 33 rotates counterclockwise about the pin 43 by which the inner end 41' of the spring 4 is fixed. Accordingly, the locking pin moves from the upper portion of the slide hole 22 to its lower portion and thus the connecting lever 5 is pulled toward its left side and the locking pin 10 is placed at the outer end of left oblong hole 51. Consequently, the right locking pin 10' is positioned between the upper end of the slide hole 22' and the outer end of the oblong hole 51', thus the hinge plate 3' is locked and can not be rotated. In this state, the door shaft 12' can not move away from the locking groove 32' because the rotation of the hinge plate 3' is impossible, even though the right side of the door may be pulled forwardly. Therefore, the door is opened at its left hand side with its right side being locked, and vice versa.

According to the present invention as described above, the hinge plates 3 and 3' are connected directly to both ends of the connecting lever 5 by means of the lock pins 10 and 10' and the torsional springs 4 and 4', the hinge plate 3' is not rotated during the rotation of the hinge plate 3 and vice verse. Therefore, the co-operation therebetween is carried out quickly and smoothly. Further, according to the present invention, additional locking plates as well as the parts for connecting the locking plates to the connecting levers are not needed as compared to the conventional door hinge arrangement, resulting in the simplified overall structure.

While the present invention has been described and illustrated herein with reference to the preferred embodiment thereof, it will be understood by those skilled in the art that various changes in form and details may be made therein without departing from the spirit and scope of the invention.

What is claimed is:

1. A door hinge arrangement enabling a door to be opened from either side, said door having the door hinge arrangement being mounted on its top edge and another of said door hinge arrangements mounted on its bottom edge, comprising:

a holder mountable to an edge of said door;

a lower plate having grooves and holes in each end thereof, said lower plate having symmetrical end portions;

an upper plate having grooves and holes in each end thereof to match the grooves and the holes of said lower plate, said upper plate also having symmetrical ends;

first and second hinge plate means pivotally mounted and sandwiched between and at respective ends of said lower plate and said upper plate;

connecting means for operably connecting said first hinge plate means to said second hinge plate means; and means disposed to travel within a first pair of said grooves at opposite ones of said end portions, for guiding said linking means as one of said hinge plate means travels between a first position enclosing a corresponding one of a second pair of said grooves and a second position opening said corresponding one of said second pair of said grooves.

2. The door hinge arrangement of claim 1, further comprised of said guiding means coupling opposite end sections of said connecting means to corresponding ones of said first and second hinge plate means.

3. A door hinge arrangement enabling a door to be opened from either side, said door having the door hinge arrangement being mounted on its top edge and another of said door hinge arrangements mounted on its bottom edge, comprising:

a holder mountable to an edge of said door;

a lower plate having grooves and holes in each end thereof, said lower plate having symmetrical ends;

an upper plate having grooves and holes in each end thereof to match the grooves and the holes of said lower plate, said upper plate also having symmetrical ends; and hinge plate means pivotally mounted and sandwiched between and at each end of said lower plate and said upper plate;

wherein each said hinge plate means includes:

a shaft;

a spring;

a hinge plate having a pivot hole for mounting said hinge plate on said shaft, said shaft being connected to a shaft hole in said upper and lower plates, a locking groove on one end of said hinge plate for engaging a door shaft, and a pin hole at the other end of said hinge plate for connecting said hinge plate to an outer end of a said spring;

a locking pin connected to a middle part of said spring, said locking pin slidably engaging arcuate slide holes in said upper and lower plates, wherein said locking pin passes through a connecting lever before engaging said arcuate slide hole of said upper plate; and wherein said spring has an inner end connected to a pin connected to pin holes in said upper and lower plates.

4. A hinge, comprising:

a plurality of locking means each having a first end containing a first groove, said first groove having an open end;

elongate means terminating with longitudinally opposite end portions, for supporting said plurality of locking means, each of said end portions containing a second groove, said second groove having an open end;

means for pivotally mounting said plurality of locking means on said elongate means, with disposition of said first groove of each of said locking means coinciding with corresponding and different ones of said second grooves;

means for biasing said locking means into first orientations relative to said corresponding ones of said second grooves; and linking means coupled to said biasing means, for operably linking said plurality of locking means via said biasing means.

5. The hinge of claim 4, further comprised of means disposed for limiting rotation of said locking means around said mounting means under influence of said biasing means while in said first orientations.

6. The hinge of claim 4, wherein:

said biasing means comprises a plurality of biasing elements, with first ends of each of said biasing elements engaging terminal portions of each of said locking means;

means for coupling second ends of each of said biasing elements to corresponding ones of said end portions; and coupling means for movably connecting each of said biasing elements with said elongate means and said linking means.

7. The hinge of claim 6, wherein:

each of said end portions contains a third groove accommodating travel by a corresponding one of said coupling means; and longitudinally opposite segments of said linking means contains fourth grooves accommodating said travel by said coupling means as a corresponding one of said locking means rotates about said mounting means between said first orientation and a second orientation.

8. The hinge of claim 7, further comprised of said linking means maintaining a first one of said coupling means in a first position with one of said locking means corresponding to said first one of said coupling means is in said first orientation, while a second one of said coupling means is in a second position with another one of said locking means corresponding to said second one of said coupling means is in said second orientation.

9. The hinge of claim 7, further comprised of said linking means maintaining a first one of said coupling means is at a first extremity of one of said third grooves when one of said locking means corresponding to said first one of said coupling means is in said first orientation, while a second one of said coupling means is at a second extremity of another one of said third grooves when another one of said locking means corresponding to said second one of said coupling means is in said second orientation.

10. The hinge of claim 7, further comprised of each of said locking means positioning said first groove to coincide with and encircle an inner extremity of said second groove while in said first position, and to coincide with and concurrently open to an outer extremity of said second groove, said outer extremity of each said second groove being open to one side of said end portion of elongate means.

11. The hinge of claim 8, further comprised of each of said locking means positioning said first groove to coincide with and encircle an inner extremity of said second groove while in said first position, and to coincide with and concurrently open to an outer extremity of said second groove, said outer extremity of each said second groove being open to one side of said end portion of elongate means.

* * * * *